US008020612B2

(12) United States Patent
Wegner

(10) Patent No.: US 8,020,612 B2
(45) Date of Patent: Sep. 20, 2011

(54) STACKED PLATE HEAT EXCHANGER FOR USE AS CHARGE AIR COOLER

(75) Inventor: Jürgen Wegner, Eislingen/Fils (DE)

(73) Assignee: Behr GmbH & Co. KG, Stuttgart (DE)

( * ) Notice: Subject to any disclaimer, the term of this patent is extended or adjusted under 35 U.S.C. 154(b) by 1027 days.

(21) Appl. No.: 11/854,862

(22) Filed: Sep. 13, 2007

(65) Prior Publication Data

US 2008/0066895 A1 Mar. 20, 2008

(30) Foreign Application Priority Data

Sep. 15, 2006 (DE) ..... 10 2006 044 154

(51) Int. Cl.
*F28F 3/08* (2006.01)
*F28F 3/12* (2006.01)

(52) U.S. Cl. ..... 165/167; 165/166

(58) Field of Classification Search ..... 165/153, 165/165, 166, 167, 168
See application file for complete search history.

(56) References Cited

U.S. PATENT DOCUMENTS

| | | | | |
|---|---|---|---|---|
| 3,117,624 | A * | 1/1964 | Wennerberg | 165/167 |
| 3,631,923 | A * | 1/1972 | Izeki | 165/167 |
| 4,572,766 | A * | 2/1986 | Dimitriou | 159/28.6 |
| 4,893,673 | A * | 1/1990 | Rosman et al. | 165/167 |
| 5,531,269 | A * | 7/1996 | Dahlgren | 165/167 |
| 6,389,696 | B1 * | 5/2002 | Heil et al. | 29/890.039 |
| 6,752,202 | B2 | 6/2004 | Holm et al. | |
| 6,823,934 | B2 * | 11/2004 | Andersson | 165/167 |
| 7,080,526 | B2 * | 7/2006 | Papapanu | 62/515 |
| 2003/0094270 | A1 | 5/2003 | Holm et al. | |
| 2007/0084592 | A1 | 4/2007 | Hendrix et al. | |
| 2007/0131402 | A1 | 6/2007 | Hendrix et al. | |

FOREIGN PATENT DOCUMENTS

| | | | |
|---|---|---|---|
| DE | 103 52 880 | A1 | 6/2005 |
| DE | 103 52 881 | A1 | 6/2005 |
| DE | 601 12 076 | T2 | 1/2006 |
| DE | 10 2005 043 294 | A1 | 3/2006 |
| WO | WO 01/67021 | A1 | 9/2001 |
| WO | WO 02/053998 | A1 | 7/2002 |

* cited by examiner

*Primary Examiner* — Tho V Duong
(74) *Attorney, Agent, or Firm* — Foley & Lardner LLP

(57) ABSTRACT

The invention relates to a stacked-plate heat exchanger for cooling charge air, having at least one first flow duct (21) for at least a first medium LL to flow through, and at least a second flow duct (22) for at least a second medium (KM) to flow through in order to cool the first medium (LL), wherein the at least one first flow duct (21) and the at least one second flow duct (22) are formed between adjacent plates (8, 9), and at least one plate (8, 9) has at least a first opening (12) for the first medium (LL) to flow through and at least two second openings (13) for the second medium (KM) to flow through into the at least one second flow duct (22), the at least one first opening (12) being arranged at least in certain sections between the two second openings (13), wherein the first opening (12) is at a smaller distance, at least in certain sections, from a central section (MA) of the stacked-plate heat exchanger (1) than one of the second openings (13).

9 Claims, 6 Drawing Sheets

Figure 2A:
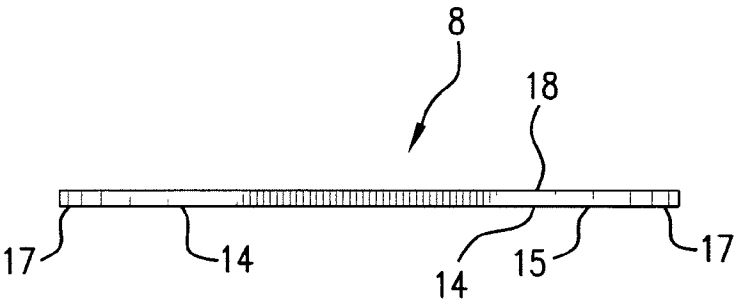

| | START | END | FUNCTION OF THE COMPENSATION CURVE |
|---|---|---|---|
| 1. SECTION | 0 | 3 | y = 1.1409x3 − 7.0677x2 + 17.735x + 0.0587 |
| 2. SECTION | 3 | 34.073 | y = −4E−05x4 + 0.0038x3 − 0.1499x2 + 3.7064x + 10.253 |
| 3. SECTION | 34.073 | 51.38 | y = −0.0021x3 + 0.2127x2 − 6.7218x + 125.6 |
| 4. SECTION | 51.38 | 52.827 | y = −2.7464x + 194.06 |
| 5. SECTION | 52.827 | 65.976 | y = −0.0043x3 + 0.8294x2 − 53.952x + 1216.5 |
| 6. SECTION | 65.976 | 67.599 | y = −0.3635x + 59.81 |
| 7. SECTION | 67.599 | 83.319 | y = −0.0014x3 + 0.2857x2 − 19.463x + 486.83 |
| 8. SECTION | 83.319 | 93.16 | y = −1.732x + 166.36 |
| 9. SECTION | 93.16 | 94.5 | y = −3.5275x3 + 990.69x2 − 92746x + 3E+06 |

STACKED PLATE HEAT EXCHANGER FOR USE AS CHARGE AIR COOLER

The present invention relates to a stacked-plate heat exchanger for cooling charge air as claimed in the preamble of claim 1.

In order to improve the power of internal combustion engines of motor vehicles and to reduce pollutants, fresh air is sucked in from the surroundings and compressed in a compressor which is driven, in particular, by means of an exhaust turbine of a turbocharger. When the charge air is compressed, the charge air is heated and must subsequently be cooled again. The charge air is cooled in what are referred to as charge air coolers. In addition, it is known that the supercharging of the charge air can take place in a plurality of stages. The sucked-in charge air is precompressed, for example, in a first compressor stage and subsequently cooled in a first charge air cooler and compressed further in a further second charge air cooler stage and/or third charge air cooler stage and subsequently cooled again.

The charge air coolers can be embodied, on the one hand, as direct charge air coolers. During the direct charge air cooling, the charge air is cooled directly by the ambient air.

In addition to direct charge air cooling, indirect charge air cooling is also known. In the case of indirect charge air cooling, a coolant, in particular a water-containing coolant, is cooled by the ambient air.

The coolant subsequently flows through the charge air cooler and in this way cools the supercharged air.

Stacked-plate coolers are known for cooling charge air. The stacked-plate coolers are a plurality of stacked plates which are stacked one on top of the other, wherein through-ducts for the charge air and/or through-ducts for the coolant are formed between adjacent stacked plates. The plates are manufactured usually by means of a reshaping and/or shaping fabrication process, stacked one on top of the other and subsequently connected to one another in a seal-forming, materially joined fashion by welding, soldering or bonding.

DE 10 2005 043 294 discloses a charge air cooler for motor vehicles. The flow ducts of the charge air cooler have inlet and outlet cross sections for the charge air, wherein internal ribs in the flow ducts each have a longitudinal extent $L_{IR}$ which is less than a length $L_{RO}$.

DE 103 52 880 discloses a heat exchanger, in particular a charge air/coolant cooler. The heat exchanger is embodied in a plate design with a plurality of plates. Between two adjacent plates an intermediate space is defined through which a heat exchanging medium flows. The heat exchanger has in each case a heat exchanging medium inlet and heat exchanging medium outlet which are common to the plates, wherein at least two heat exchanging medium ducts are provided in each case for each heat exchanging medium inlet and/or heat exchanging medium outlet. The heat exchanging medium ducts are preferably formed here by means of breakthroughs, which are in particular aligned with one another, in the individual plates.

DE 103 52 881 also discloses a heat exchanger, in particular a charge air/coolant cooler, which is formed in a plate design. The heat exchanger has a plurality of plates through which a coolant and a fluid to be cooled flow. The inflow and/or outflow region of a fluid which is to be cooled, such as for example charge air, is formed in an extended fashion here.

The object of the present invention is to improve a stacked-plate heat exchanger of the type mentioned at the beginning, to make it more cost effective and more economical in terms of installation space, in particular to improve the flow of the coolant, in particular the cooling water, in the inlet area of the hot charge air which is to be cooled, in such a way that the coolant does not boil or does not change its aggregate state. In particular, the intention is also to improve the rigidity of the ring end sections in which, in particular, charge air which is to be cooled flows in and out, and/or to improve in particular the support for adjacent plates.

The object is achieved by the features of claim 1.

A stacked-plate heat exchanger for cooling charge air is proposed which has at least one first flow duct for at least a first medium to flow through, and at least a second flow duct for at least a second medium to flow through in order to cool the first medium, wherein the at least one first flow duct and the at least one second flow duct are formed between adjacent plates, and at least one plate has at least a first opening for the first medium to flow through and at least two second openings for the second medium to flow through into the at least one second flowduct, the at least one first opening being arranged at least in certain sections between the two second openings, wherein the first opening is at a smaller distance, at least in certain sections, from a central section of the stacked-plate heat exchanger than one of the second openings.

The at least one first flow duct serves for at least the first medium, in particular charge air to flow through, and in particular a plurality of first flow ducts are provided. The at least one second flow duct, in particular the second flow ducts, serve for at least a second medium, in particular coolant such as water-containing coolant, to flow through in order to cool the first medium, in particular the charge air. The at least one first flow duct, in particular the first flow ducts, are formed between adjacent plates, in particular plates which are stacked one on top of the other and are connected to one another in a materially joined fashion. The at least one second flow duct, in particular the second flow ducts, are formed between adjacent plates, in particular plates which are stacked one on top of the other and connected to one another in a materially joined fashion.

The at least one plate, in particular the plates, have at least one first opening, in particular two first openings, for the first medium, in particular charge air, to flow through. In addition, the at least one plate, in particular the plates, has at least two second openings, in particular in each case two second openings, two for the second medium, in particular the coolant, to flow in through and in particular two for it to flow out through. The at least one first opening is arranged at least in certain sections between the two second openings. In particular, for the inflow area, a first opening is arranged between two second openings and a further first opening is arranged between two further second openings.

The at least one first opening, in particular the respective first openings, are at a smaller distance, at least in certain sections, from a central section, in particular from the center of the stacked-plate heat exchanger, than one of the second openings. In particular, a section of the first opening protrudes further in the direction of the center, in particular in the direction of the central section, of the stacked-plate heat exchanger.

In addition, a stacked-plate heat exchanger for cooling charge air according to the preamble of claim 1 is proposed, wherein at least one knob, in particular a plurality of knobs, for stiffening the at least one plate end ring section and thus the stacked-plate heat exchanger is introduced into at least one plate end ring section, in particular into one plate end ring section in each case. In particular, as a result the plate end ring section which comprises in particular the at least one first opening for the first medium, in particular charge air, to flow through, is stiffened and/or its adjacent plate end ring sections are spaced apart from one another. In particular, adjacent plate end ring sections of adjacent plates are supported on one another.

In one advantageous development, at least one bead for separating the second medium of the coolant from the first medium, in particular the charge air, and for directing the flow of the second medium, in particular the coolant, is formed from the at least one plate, in particular the plates. In this way it is possible, in a particularly advantageous and space-saving fashion, for a second medium and a first medium to flow on one plane of a plate, in particular on the same plane of a plate, without mixture occurring. The rigidity of the plate is particularly advantageously improved by the bead and/or an additional contact surface, in particular a connecting surface between the stacked plates, is provided.

In addition it is possible to provide that at least one bead end section of the at least one bead is formed substantially in the shape of a delta in the region of the second openings, and/or that the at least one bead end section surrounds the second opening at least in certain areas. In this way it is possible for the second coolant to flow in a particularly advantageous way without a change of aggregate state, in particular without boiling, through the stacked-plate heat exchanger, in particular the at least one second flow duct. In particular, the plates and/or plate connecting surfaces are in contact with one another at least in certain sections and are, for example, connected to one another in a materially joined fashion, in particular by welding, soldering, bonding etc.

In one advantageous development, the at least one bead extends from the one second opening to the other second opening. In this way, at least one plate area through which the first medium, in particular charge air, flows is separated, particularly advantageously in a seal-forming fashion, from a second area through which coolant, in particular water-containing coolant, flows.

In one development, the first opening is of symmetrical design. This particularly advantageously produces a boiling-free flow of the second medium, in particular of the coolant, in the direction of the heat exchanger central section or from the heat exchanger central section to the openings. In another embodiment, the first opening is of asymmetrical design.

In one advantageous development, at least one edge is designed to delimit the at least one first opening at least in certain sections in a substantially V shape and/or with at least one curve. In this way, the opening for the entry of the first medium, in particular the charge air, can particularly advantageously be enlarged so that the throughput rate of cooled charge air can be particularly advantageously increased, wherein boiling of the second medium, in particular of the coolant in the region of the second openings can be particularly advantageously prevented at the same time without the rigidity of the heat exchanger decreasing.

In addition it is possible to provide for the at least one edge to have substantially the shape of a normal distribution function at least in certain sections. In this way it is particularly advantageous to prevent boiling of the second medium, in particular of the coolant, since a particularly advantageous flow of the second medium is brought about without forming dead water regions.

In a further embodiment, the at least one edge can be formed or is formed at least in certain sections with at least one polynomial $y_n=a_nx^4+b_nx^3-c_nx^2+d_nx+e_n$ with n=1, 2, 3, 4, . . . .

In addition, it is possible to provide that the at least one edge in the region of the plate end ring section is spaced apart from the plate edge of the plate by 2 mm to 30 mm, in particular 5 mm to 20 mm. In this way an optimal opening surface of the first opening for the first medium, in particular of the charge air, is formed, without the rigidity of the stacked-plate heat exchanger and/or the tightness of the seal of the stacked-plate heat exchanger being degraded, in particular in the plate end ring sections.

In a further advantageous embodiment, the at least one edge has an edge section which encloses at least in certain areas an angle $\alpha$ with a flow direction FR of the first medium, wherein the angle $\alpha$ assumes values between 40° and 70°, in particular values between 45° and 65°. In this way, an optimum formation of the first opening is achieved, as a result of which in particular the flow of the second medium, in particular the coolant, is formed or can be formed in such a way that the second medium, in particular the coolant, does not boil in particular in the region of the inlet openings for the second medium, in particular the coolant, and dead water regions of the second medium, in particular of the coolant, are particularly advantageously avoided.

Further advantageous refinements of the invention emerge from the subclaims and from the drawing.

Figure 2B:
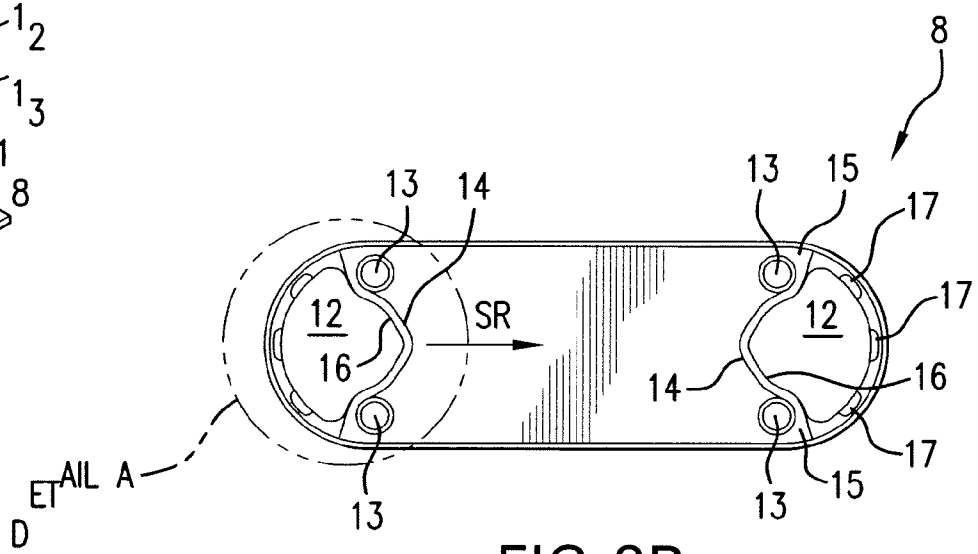
Figure 1:
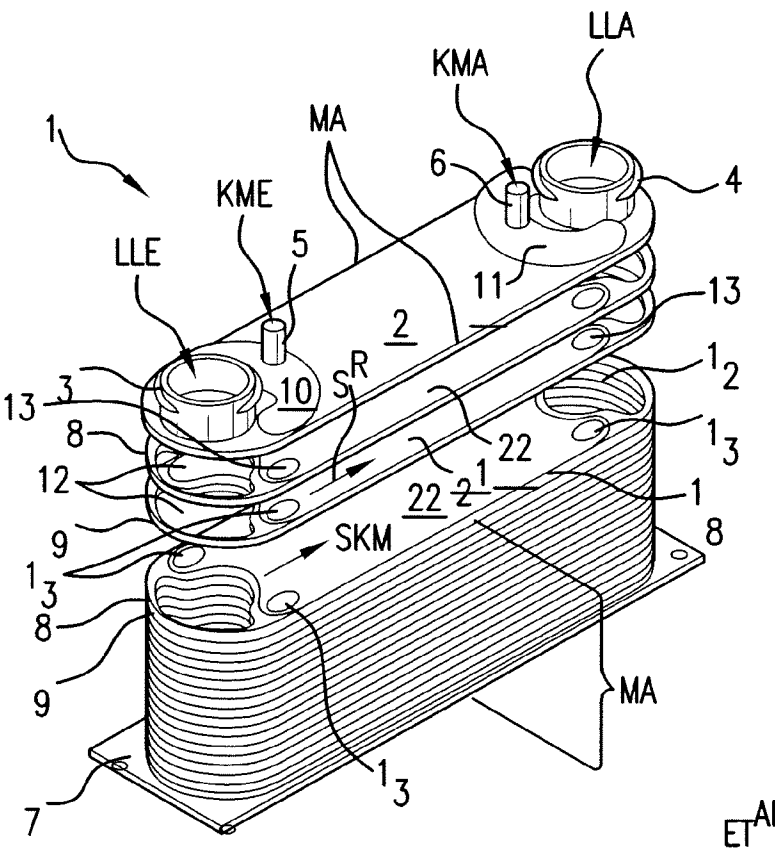
Figure 4:
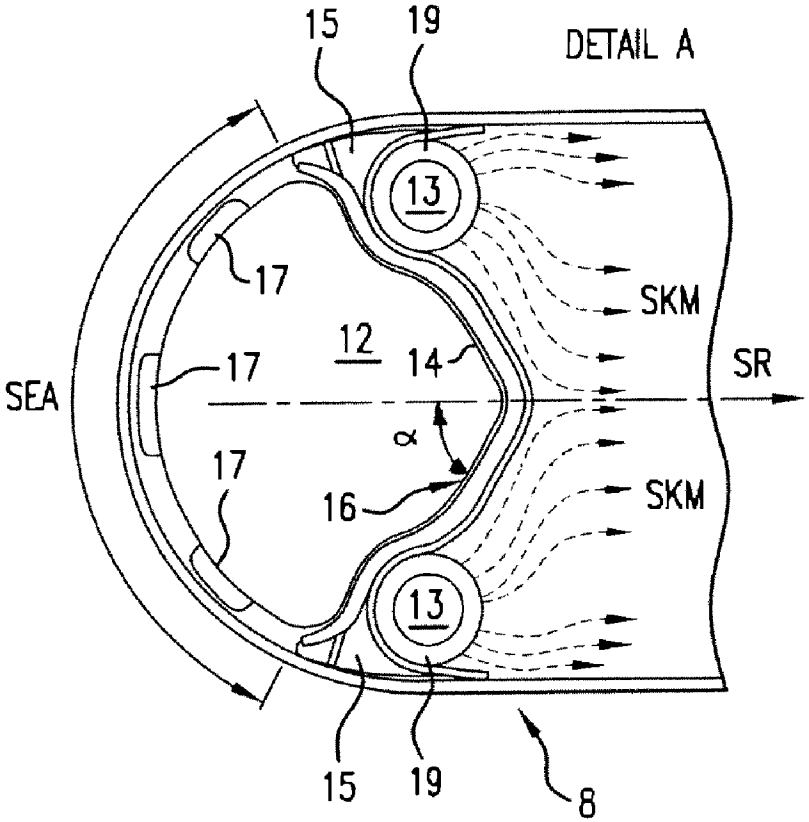
Figure 3:
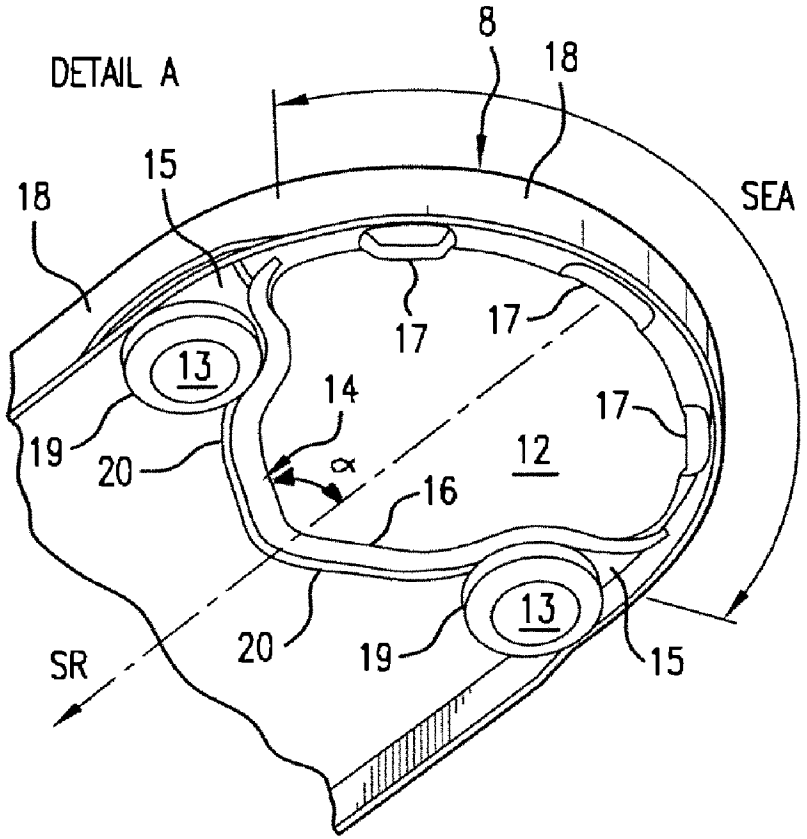
Figure 5:
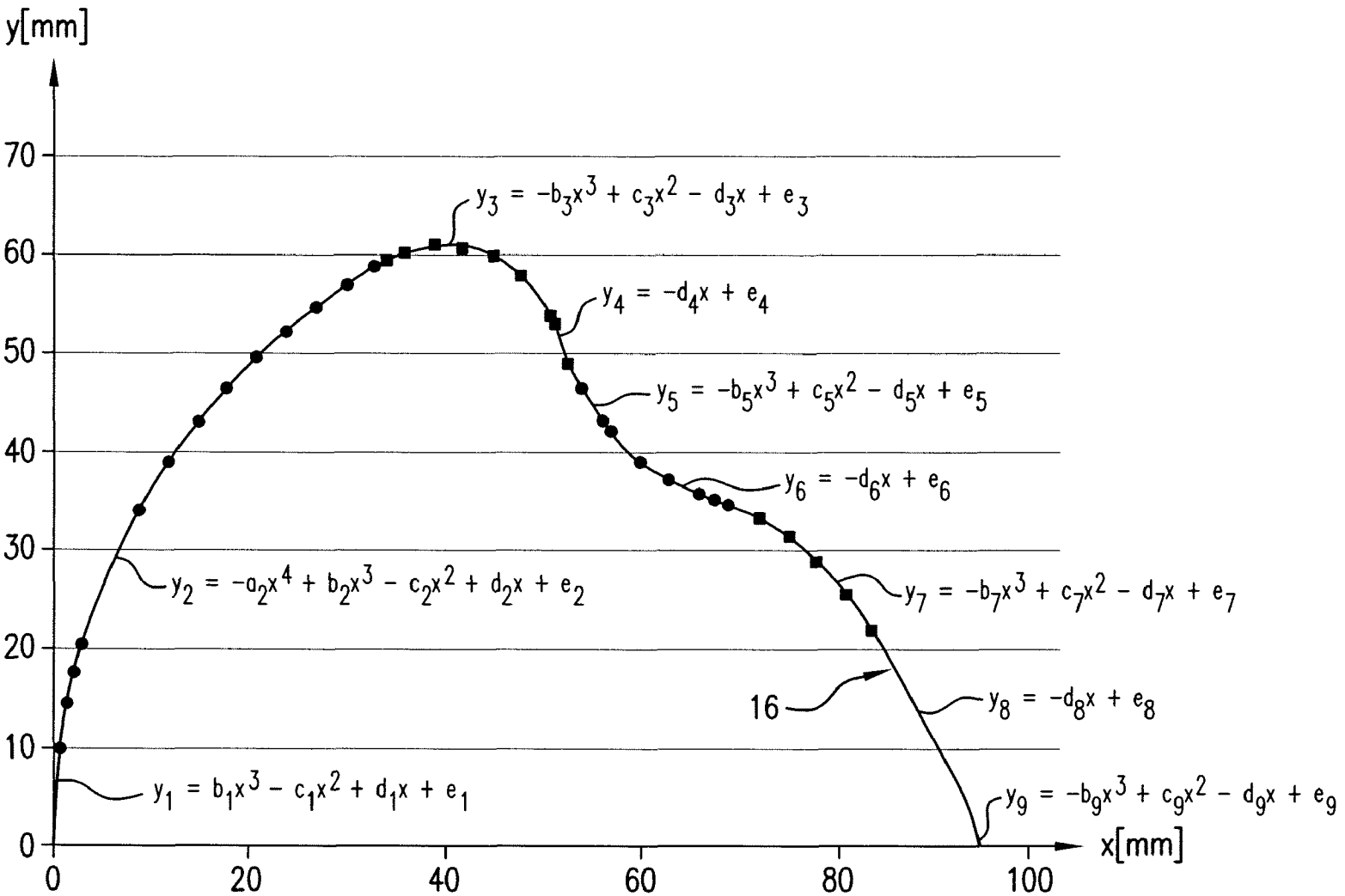
Figures 6, 7:
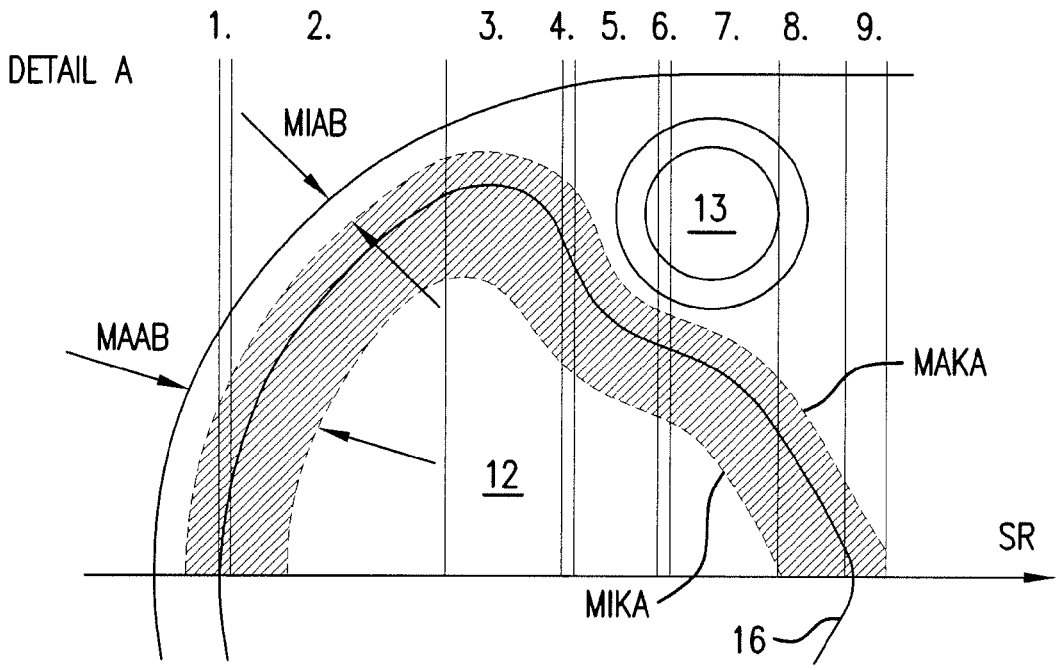
Figure 8:
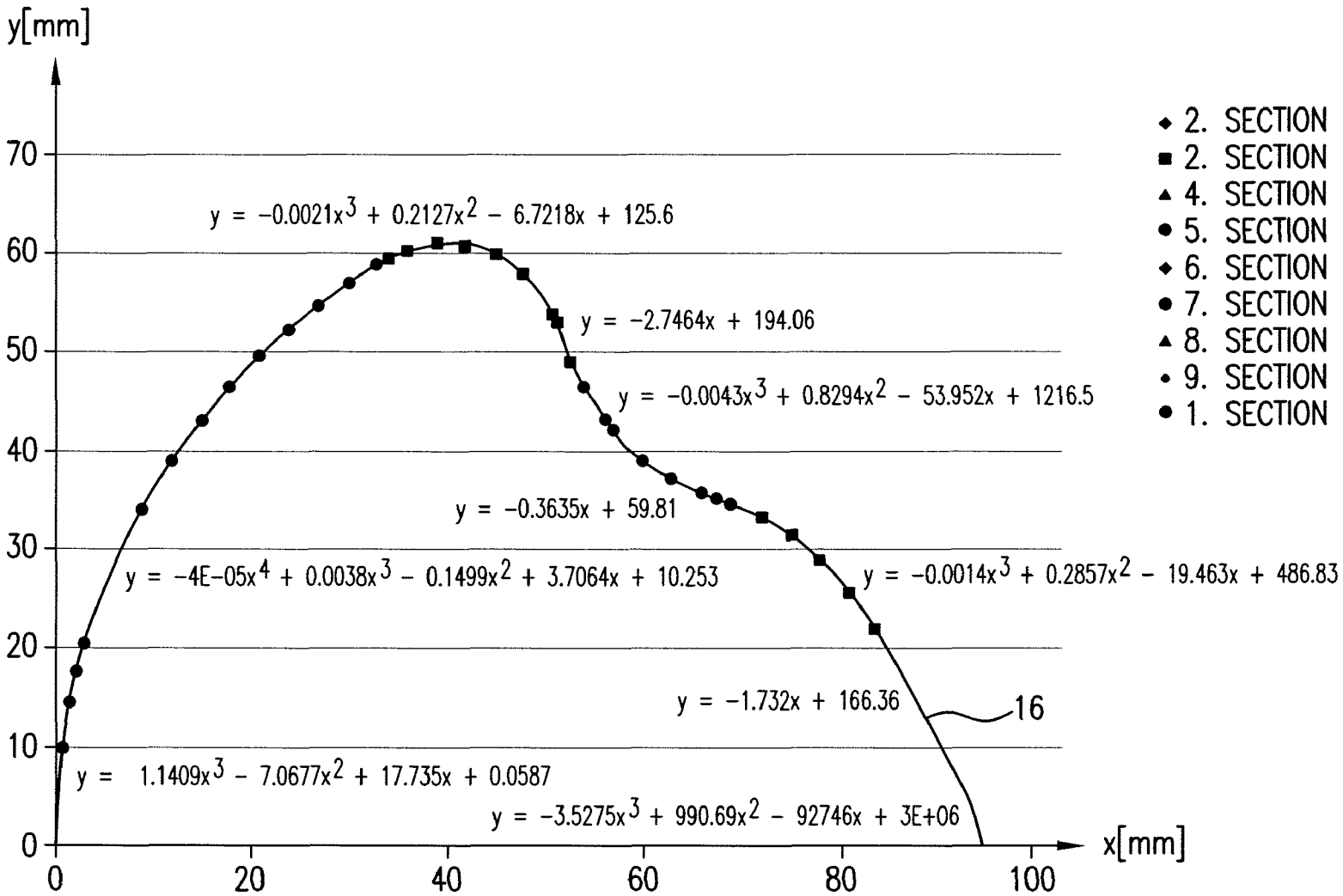
Figure 9:
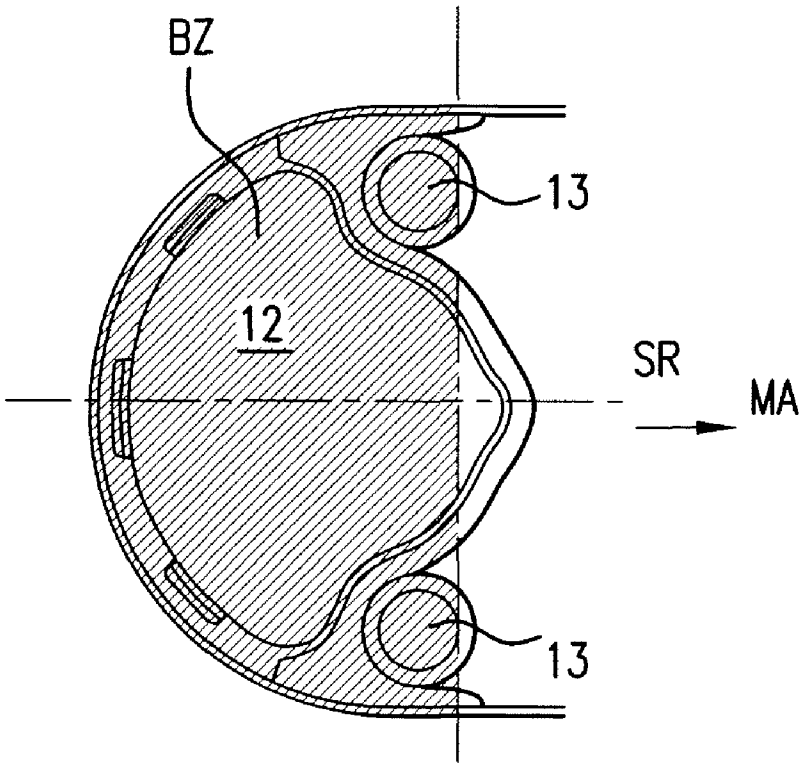

Exemplary embodiments of the invention are illustrated in the drawing and will be explained in more detail in the text which follows, this not being intended to constitute a restriction of the invention. In the drawing:

FIG. 1: is an isometric exploded illustration of a stacked-plate heat exchanger;

FIG. 2*a*: is a side view of a plate of a stacked-plate heat exchanger;

FIG. 2*b*: is a plan view of a plate of a stacked-plate heat exchanger;

FIG. 3: is an isometric illustration of the detail a of a plate;

FIG. 4: is a plan view of the detail a of a plate;

FIG. 5: is an illustration of the edge of the first opening with nine polynomials;

FIG. 6: shows an exemplary embodiment of the edge of the first opening with nine polynomials;

FIG. 7: shows an exemplary embodiment with a table with nine polynomials for illustrating the edge of the first opening;

FIG. 8: shows an exemplary embodiment of the edge of the first opening as an illustration with nine polynomials;

FIG. 9: shows a reference surface of the first opening; and

Figure 10:
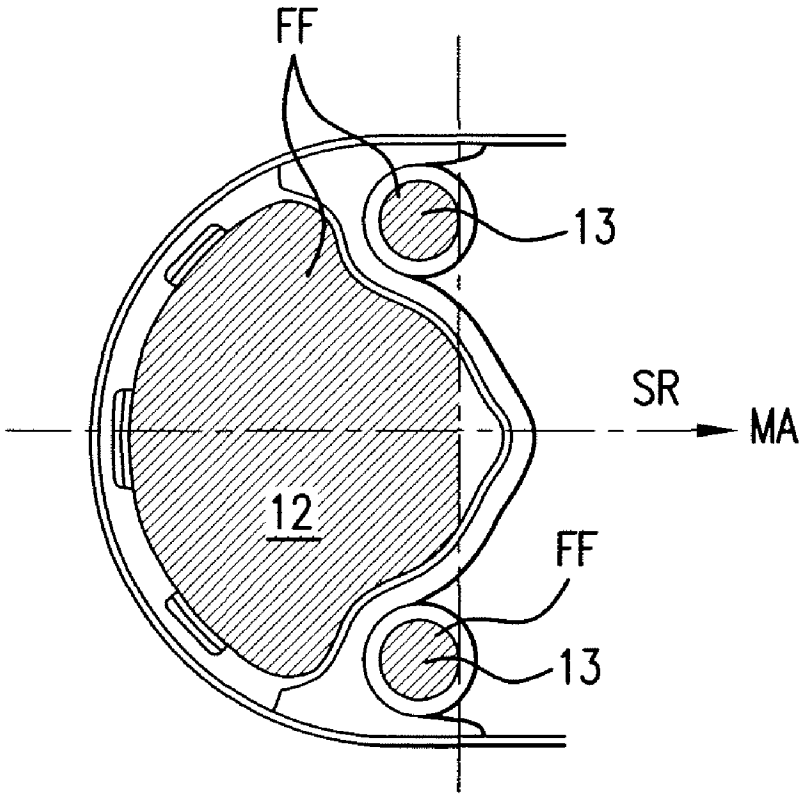

FIG. 10: shows a free surface of the first opening.

FIG. 1 shows an isometric exploded illustration of a stacked-plate heat exchanger 1.

The stacked-plate heat exchanger 1 has at least one cover plate 2, a number of first plates 8, a number of second plates 9 and a base plate 7. The cover plates 2 can also be embodied as a cover panel 2. First plates 8 and second plates 9 are stacked one on top of the other onto the base plate 7 and connected to one another in a materially joined fashion, in particular by soldering, welding, bonding etc. The base plate 7 is also connected to the plate stack (not designated in more detail) in a materially joined fashion, in particular by welding, soldering, bonding etc. The cover plate 2 is fitted onto the plate stack (not designated in more detail) and is connected to the plate stack (not designated in more detail) in a materially joined fashion, in particular by welding, soldering, bonding etc.

The cover plate 2 has at least one charge air feed connecter 3 and at least one charge air discharge connecter 4. The charge air feed connecter 3 and/or the charge air discharge connecter 4 are connected to the cover plate 2, in particular in a materially joined fashion. In another exemplary embodiment, the at least one charge air feed connecter 3 and the at least one charge air discharge connecter 4 are embodied in one piece with the cover plate 2. In addition, a distribution duct 10, which is supplied with coolant KM by the coolant inlet KME via a coolant feed connecter 5, is connected to the cover plate 2. The distribution duct 10 distributes inflowing coolant KM among the at least two second openings for the coolant inlet KME of the coolant KM into the stacked-plate heat exchanger 1. In addition, at least one combination duct 11 is connected to the cover plate 2. The combination duct 11 combines coolant KM which has flowed through the stacked-plate heat exchanger 1 in order to discharge the coolant KM again from the stacked-plate heat exchanger 1 via the coolant outlet KMA using the coolant discharge connecter 6.

In another exemplary embodiment, the feed connecter 5 and/or the distribution duct 11 and/or coolant discharge connecter 6 are embodied in one piece for the cover plate 2. The cover plate 2 is formed from metal such as, for example, aluminum, stainless steel, steel or from some other material such as a heat-resistant plastic or from a composite fiber material. Likewise, the charge air feed connecter 3 and/or charge air discharge connecter 4 and/or the distribution duct 10 and/or the combining duct 11 and/or the coolant feed connecter 5 and/or coolant discharge connecter 6 are formed from a metal such as, for example, aluminum, steel or from stainless steel or from some other metal or, for example, from plastic and/or from a composite fiber material. The cover plate 2 is manufactured by means of a shaping fabrication method such as, for example casting or injection molding and/or by means of a reshaping fabrication method such as, for example, punching, stamping. The cover plate 2 is formed, for example, as a cover panel 2. In particular, the cover plate 2 or the cover panel 2 is cut out from a piece of sheet metal or a panel by means of a cutting fabrication method such as, for example, beam or jet cutting, in particular laser beam cutting or water jet cutting. The cover plate 2 or the cover panel 2 has a thickness of 2 mm to 12 mm, in particular of 6 mm to 10 mm. In a further exemplary embodiment, in addition to the cover plate 2 or the cover panel 2 a further second cover plate is provided which has in particular a smaller thickness than the cover plate 2 or the cover panel 2 and is manufactured in particular by means of a reshaping fabrication method.

The plate stack (not designated in more detail) is formed from first plates 8 and from second plates 9. In a first exemplary embodiment, a first plate 8 is stacked alternately on a second plate 9.

In another exemplary embodiment (not illustrated) a number of first plates 8 are stacked one on top of the other, subsequently followed by a stack of second plates 9 which are stacked one on top of the other.

In a further exemplary embodiment (not illustrated), the plate stack (not designated in more detail) can be formed only from first plates 8 or from second plates 9.

The first plate 8 and/or the second plate 9 are formed from a material such as, for example, aluminum, stainless steel, steel or from some other metal, or in another exemplary embodiment from a fiber composite material or from a heat-resistant plastic. The at least one first plate 8 and/or the at least one second plate 9 are manufactured by means of a reshaping fabrication method such as, for example, punching, stamping, perforating etc. and/or by means of a shaping fabrication method such as, for example, injection molding or laminating. The at least one first plate 8 and/or the at least one second plate 9 each have at least one, in particular two first openings 12. Charge air LL, which in particular has still to be cooled, flows through the first opening 12. Charge air which has already been cooled flows through the second first opening 12, in the direction of the charge air outlet LLA. In addition, the at least one first plate 8 and/or the at least one second plate 9 have at least two openings 13, in particular four second openings 13. Two first second openings 12 serve here for coolant KM to flow in, and the two other second openings 13 serve here for coolant KM to flow out. Between an adjacent first plate 8 and a second plate 9 which is adjacent thereto, either a first flow duct 21 is formed here for charge air LL to flow through or a second flow duct 22 for coolant KM to flow through.

The base plate 7 is formed substantially in a rectangular shape and/or round and/or triangular shape and/or ellipsoidal shape and/or star shape or from any desired combination of the previously mentioned shapes. In the illustrated exemplary embodiment 4, the base plate 7 has bores (not designated in more detail) for attaching the stacked-plate heat exchanger 1. The plate stack (not designated in more detail) is connected to the base plate 7 in a materially joined fashion, in particular by welding, bonding, soldering etc. and/or in a positively locking fashion, for example by flanging or crimping or screwing. The first plate 8 and/or the plate 9 and/or the cover plate 2 are of substantially rectangular design, in which case in particular the plate ends (not designated in more detail) are substantially in the shape of a semicircle and/or circular segment.

The first plates 8 and the second plates 9 are stacked one on top of the other and connected in a bundling process in such a way that they remain under prestress during a subsequent connection process, in particular in an oven. The first plates or the second plates 9 and/or the base plate 7 and/or cover plate 2 are solder plated at least in certain areas, in particular completely at least on one side or on both sides. After the pre-bundling, the plate stack is introduced, with the cover plate 2 and the base plate 7, into an oven, in particular into a soldering oven, in such a way that the cover plate 2 of the plate stack and the base plate 7 are connected to one another in a materially joined and/or seal-forming fashion, being in particular soldered, welded or bonded.

In another exemplary embodiment, either only the charge air feed connecter 3 or the charge air discharge connecter 4 is arranged in the cover plate 2, or in another exemplary embodiment neither the charge air feed connecter 3 nor the charge air discharge connecter is arranged. In this case, the charge air feed connecter 3 and/or the charge air discharge connecter 4 are arranged in the base plate 7. In another exemplary embodiment, the coolant feed connecter 5 and/or the coolant discharge connecter 6 are likewise not arranged on the cover plate 2 but rather in the base plate 7. In another exemplary embodiment, either the coolant feed connecter 5 is arranged on the cover plate 2 and the coolant discharge connecter 6 is arranged on the base plate 7.

FIG. 2*a* shows a side view of a plate 8 of a stacked-plate heat exchanger 1. Identical features have been provided with identical reference symbols as in FIG. 1.

FIG. 2*a* shows the first plate 8. Plate 8 has a plate edge 18 which runs around substantially, in particular completely. The plate edge 18 has, with respect to the base surface of the plate, an angle which is not designated in more detail and assumes, in particular, values between 20° and 90°, in particular values between 30° and 85°, in particular values between 35° and 80°. At the ends (not designated in more detail) of the plate 8, at least one knob 17 is formed, in the downward direction. Likewise, in each case one bead 14 is formed in the downward direction from the plate 8 in the region of the first opening 12. The at least one bead 14, in particular the two beads 14 of a plate and/or the at least one knob 17, in particular the respective three knobs 17, are formed from the plate 8, 9 by means of a shaping fabrication method such as, for example, punching or stamping. In another exemplary embodiment, the at least one knob 17 and/or the at least one bead 14 is formed separately from a piece of sheet metal and subsequently connected to the plate, in particular in a materially joined fashion, in particular by welding, soldering, bonding, etc. The at least one bead 14 has at least one bead end section 15, in particular two bead end sections 15.

In contrast to the first plate 8, the at least one bead 14 in particular the two beads 14 and/or the at least one knob 17, in particular the respective three, i.e. total of six knobs, in the case of the second plate 9 are formed in the upward direction, in contrast to the plate 8 where said knob 17 is formed in the downward direction.

FIG. 2*b* shows a plan view of a plate 8 of a stacked-plate heat exchanger 1. Identical features have been provided with the same reference symbols as in the previous figures.

In the illustrated exemplary embodiment, the first plate 8 has two second openings 13 on each side, that is to say a total of four second openings 13. In the region of the plate ends (not designated in more detail) in each case a first opening 12 is arranged. Plate 8 therefore has at least a total of two first openings 12. The first openings 12 and/or the second openings 13 are formed from the plate 8 by means of a reshaping fabrication method such as stamping, punching and/or by means of a material-removing fabrication method such as, for example, boring, milling, laser beam welding. The plate ends (not designated in more detail) are formed substantially in the shape of a semicircle and/or circular segment. In the region of the plate ends (not designated in more detail), there is in each case a plate end ring section, three knobs 17 are formed from the plate 8. The knobs 17 are formed substantially similarly with a rectangular shape and/or elongated round shape. A plate 8 has two ring end sections. In another exemplary embodiment, one, two, three, four or five knobs are formed from the plate 8 or introduced into the plate 8 in, in each case, one plate ring end section. In the region in which the plate ends (not designated in more detail) which are formed in the shape of a semicircle are continuous with the substantially rectangular part of the plate 8 (not designated in more detail), in each case a wide opening 13 is made in the plate 8 in the region of the plate edge. In the illustrated exemplary embodiment, the at least one second opening 13 is formed in a circular shape. In another exemplary embodiment, the at least one second opening 13 has an ellipsoidal cross section and/or rectangular cross section and/or triangular cross section and/or a quadrilateral cross section or a cross section composed of any desired combination of the previously mentioned cross-sectional shapes. In total, four second openings 13 are introduced into a plate 8 the illustrated exemplary embodiments. A bead 14 runs between the respective two second openings 13 in the region of the plate ends. The bead 14 bounds the at least one first opening 12 of the plate 8 at least in certain areas. The bead 14 extends substantially parallel to the edge 16 of the at least one first opening 12. In the region of the second opening 13, the bead 14 widens in each case in the region of a bead end section in the shape of a delta and engages around or flows around the second opening 13 as it were. A bead 14 therefore has at least two bead end sections 15, one in the region of each of the respective openings 13. In this way, the two beads 14 separate the in each case two plate end regions which are formed substantially in the shape of a semicircle, from a plate central region which is formed substantially in the shape of an X. The edges 6 are formed here substantially by the beads 14.

The plate 9 differs from the plate 8 only in that the at least one bead 14 and the knobs 17 are formed with respect to the other side of the plate, i.e. to the opposite side of the plate. Furthermore, in another exemplary embodiment, the knobs 17 of one plate are formed alternately with respect to one side of the plate and with respect to the opposite other side of the plate. In the direction of flow SR, the charge air flows through the plate. In another exemplary embodiment, the charge air flows counter to the direction of flow SR.

FIG. 3 shows an isometric illustration of the detail a of a plate 8. Identical features have been provided with identical reference symbols to those in the previous figures.

The detail a shows in each case an end region of a plate 8 in enlarged form. The first opening 12 is of symmetrical design here and is bounded by the edge 16 of the plate 8. The opening 12 is embodied in such a way that a first opening region is formed substantially in the form of a semicircle or circular segment, and a second opening region of the opening 12 has substantially the shape and/or the area of a normal distribution function. In the region in which the edge 16 is embodied substantially in the form of a normal distribution function, the bead 14 extends substantially parallel to the edge 16. The at least one first opening 12 is arranged here between the at least two second openings 13. The second openings 13 have here a mandrel 19 which is at least substantially in the form of a conical section. The edge 16, in particular the bead 14, has an edge section 20 which has an angle $\alpha$ with the direction SR of flow of the charge air, or in another exemplary embodiment of the direction of flow of the coolant. The angle $\alpha$ assumes values between 40° and 70°, in particular values between 45° and 65° here.

The bead 14 is in contact with the bead end sections which are formed substantially in the shape of a delta and engage around the second opening 13 or enclose the plate edge 18).

The first opening 12 is embodied essentially symmetrically, in particular axially symmetrically with respect to the direction of flow SR. The plate end ring section SEA is formed in particular in the shape of a circular segment, and in particular is formed in one piece with the plate 8. In the illustrated exemplary embodiment, the central knob 17 is embodied in the upward direction, while the two other knobs 17, which are respectively arranged to the right and left of the first knob 17, are formed substantially in the downward direction, opposed to the direction of the first knob 17.

FIG. 4 shows a plan view of the detail a of a plate 8. Identical features have been provided with the same reference symbols as in the previous figures.

In particular the flow profile of the coolant SKM in the second flow ducts 22 is additionally illustrated in FIG. 4. In particular, the flow of the coolant KM flows in particular adjacent to the bead 14, substantially parallel in such a way that no dead water regions are formed, and the coolant therefore does not change the aggregate state and change from the liquid state into the gaseous state. In this way, boiling of the coolant is particularly advantageously prevented.

FIG. 5 shows an illustration of the edge 16 of the first opening 12, with just the half of the edge 16 being illustrated since the opening 12 is axially symmetrical to the x axis. The x axis corresponds in this case to the flow direction SR, therefore extends in particular in the direction of flow on the central axis of the plate. Identical features have been provided with the same reference symbols as in the previous figures.

The unit of the x axis is plotted in millimeters, and the y axis, which extends substantially perpendicularly with respect to the x axis, in particular with respect to the direction of flow SR, is plotted against the x axis. The unit of the y axis is also millimeters. The edge 16 of the first opening 12 can be represented by means of at least one polynomial, in particular by means of a plurality of polynomials $Y_N=a_nx^4+b_nx^3-c_nx^2+d_nx+e_n$ with n=1, 2, 3, 4, 5, 6, 7, 8, 9 . . . or is represented in this way. In the illustrated exemplary embodiment, half of the edge 16 is illustrated by means of nine polynomials. The nine curves are set one against the other and thus form half of the edge 16.

$$y_1=b_1x^3-c_1x^2+d_1x+e_1 \quad \text{Polynomial 1}$$

$$y_2=-a_2x^4+b_2x^3-c_2x_2+d_2x+e_2 \quad \text{Polynomial 2}$$

$$y_3=b_3x^3-c_3x^2+d_3x+e_3 \quad \text{Polynomial 3}$$

$$y_4=d_4x+e_4 \quad \text{Polynomial 4}$$

$$y_5=b_5x^3-c_5x^2+d_5x+e_5 \quad \text{Polynomial 5}$$

$$y_6=d_6x+e_6 \quad \text{Polynomial 6}$$

$$y_7=b_7x^3-c_7x^2+d_7x+e_7 \quad \text{Polynomial 7}$$

$$y_8=d_8x+e_8 \quad \text{Polynomial 8}$$

$$y_9=b_9x^3+c_9x^2-d_9x+e_9 \quad \text{Polynomial 9}$$

If a value for x is inserted into the polynomial of the corresponding region, the y value is obtained here.

FIG. 6 shows an exemplary embodiment of the representation of the edge (16) by means of the nine polynomials. Here, the nine regions 1 to 9 in which the respective polynomials apply are represented in FIG. 8. Here, the edge (16) shows the polynomial with the preferred embodiment. Furthermore, limiting values for the opening have to be complied with. There is a maximum edge MAKA which is at the minimum distance MIAB from the plate edge. The minimum distance MIAB assumes values here between 2 mm and 5 mm, in particular between 3 mm and 4.5 mm. The smallest opening of the first opening (12) is bounded here by the minimum edge (MIKA). The minimum edge is at the maximum distance MAAB from the plate edge in the region of the plate end ring section. The maximum distance assumes values between 20 mm and 30 mm, in particular values between 25 mm and 29 mm here. As a result, the edge (16) can extend between the minimum edge MIKA and the maximum edge MAKA.

FIG. 7 shows an exemplary embodiment with the associated value table of the nine polynomials and its respective areas of application. Start therefore designates the x value of the start of the respective polynomial. End designates the x value of the end of the interval in which the respective polynomial applies. Function of the compensation curve designates the respective polynomial of the respective section. The respective polynomial is here a preferred exemplary embodiment of the polynomial which is illustrated respectively in FIG. 5. The coefficients of the polynomials can preferably assume the following values here:

$$y_1=b_1x^3-c_1x^2+d_1x+e_1 \quad \text{Polynomial 1}$$

with $1.0 \leqq b_1 \leqq 1.2$: in particular $b_1=1.1409$
$7.0 \leqq c_1 \leqq 7.2$; in particular $c_1=7.0677$
$17.0 \leqq d_1 \leqq 18.0$; in particular $d_1=17.735$
$0.01 \leqq e_1 \leqq 0.0587$; in particular $e_1=0.0587$ $$y_2=-a_2x^4+b_2x^3-c_2x_2+d_2x+e_2 \quad \text{Polynomial 2}$$

with $3.5*10^{-5} \leqq a_2 \leqq 4.5*10^{-5}$; in particular $a_2=4.0*10^{-5}$
$0.0030 \leqq b_2 \leqq 0.0045$; in particular $b_2=0.0038$
$0.13 \leqq c_2 \leqq 0.155$; in particular $c_2=0.1499$
$3.5 \leqq d_2 \leqq 3.9$; in particular $d_2=3.7064$
$10.0 \leqq e_2 \leqq 10.5$; in particular $e_2=10.253$ $$y_3=b_3x^3-c_3x^2+d_3x+e_3 \quad \text{Polynomial 3}$$

$0.001 \leqq b_3 \leqq 0.005$; in particular $b_3=0.0021$
$0.19 \leqq c_3 \leqq 0.25$; in particular $c_3=0.2127$
$6.5 \leqq d_3 \leqq 6.9$; in particular $d_3=6.7218$
$124 \leqq e_3 \leqq 126$; in particular $e_3=125.6$ $$y_4=d_4x+e_4 \quad \text{Polynomial 4}$$

with $2.5 \leqq d_4 \leqq 2.9$; in particular $d_4=2.7464$
$192 \leqq e_4 \leqq 196$; in particular $e_4=194.6$ $$y_5=b_5x^3-c_5x^2+d_5x+e_5 \quad \text{Polynomial 5}$$

with $0.004 \leqq b_5 \leqq 0.0049$; in particular $b_5=0.0043$
$0.80 \leqq c_5 \leqq 0.89$; in particular $c_5=0.8294$
$53.0 \leqq d_5 \leqq 54.5$; in particular $d_5=53.952$
$1214 \leqq e_5 \leqq 1218$; in particular $e_5=1216.5$ $$y_6=d_6x+e_6 \quad \text{Polynomial 6}$$

with $0.34 \leqq d6 \leqq 0.39$; in particular $d_6=0.3635$
$57.0 \leqq e_6 \leqq 61.0$ in particular $e_6=59.81$ $$y_7=b_7x^3-c_7x^2+d_7x+e_7 \quad \text{Polynomial 7}$$

with $0.0011 \leqq b_7 \leqq 0.0017$; in particular $b_7=0.0014$
$0.25 \leqq c_7 \leqq 0.30$; in particular $c_7=0.2857$
$19.1 \leqq d_7 \leqq 19.7$; in particular $d_7=19.463$
$484.0 \leqq e_7 \leqq 489.0$; in particular $e_7=486.83$ $$y_8=d_8x+e_8 \quad \text{Polynomial 8}$$

with $1.4 \leqq d_8 \leqq 1.9$; in particular $d_8=1.732$
$163 \leqq e_8 \leqq 169$ in particular $e_8=166.36$ $$y_9=b_9x^3+c_9x^2-d_9x+e_9 \quad \text{Polynomial 9}$$

with $3.3 \leqq b_9 \leqq 3.7$; in particular $b_9=3.5275$
$988 \leqq c_9 \leqq 992$; in particular $c_9=990.69$
$92740 \leqq d_9 \leqq 92750$; in particular $d_9=92746$
$2.5*10^6 \leqq e_9 \leqq 3.5*10^6$; in particular $e_9=3.0*10^6$ FIG. 8 shows the preferred exemplary embodiment of the representation of the edge (16) with the respectively associated polynomials for the respective nine polynomial sections.

FIG. 9 shows a reference surface BZ of a plate end region of the plate (8, 9), and the free cross sectional surface FF of the first opening (12) and of the associated two second openings (13) is illustrated in FIG. 10. Identical features are provided with identical reference symbols as in the previous figures.

The reference surface assumes here values between 5,000 $mm^2$ and 20,000 $mm^2$, in particular values between 10,000 $mm^2$ and 15,000 $mm^2$, in particular values between 12,000 $mm^2$ and 14,000 $mm^2$. In the illustrated exemplary embodiment, the reference surface BZ is 12,006 $mm^2$. Here, the free cross sectional area FF is formed from the two opening cross sections of the second openings (13) and from a part of the opening cross section of the first opening (12). Here, the part of the opening cross section of the first opening (12) which merges with the free area FF is formed by the opening area section which by the tangent which is closest to the central section MA, which forms a tangent to the two second openings (13) and the edge (16) which in the region of the ring end section SEA. The free cross section FF assumes in particular values between 7,000 $mm^2$ and 10,000 $mm^2$, in particular between 7,810 $mm^2$ and 9,210 $mm^2$ here. Here it is possible to form a ratio BZ/FF which is, in particular 0.5 to 0.9, in particular 0.6 to 0.8, in particular 0.65 to 0.77.

Turbulence plates with turbulence-generating formations such as knobs or vanes are introduced in particular into the first flow ducts 21 and/or into the second flow ducts 22 in order to improve the transmission of heat. The turbulence plates are materially joined, for example, to the at least one first plate 8 and/or to the at least one second plate 9, in particular by means of soldering, welding, bonding etc. In another exemplary embodiment, turbulence-generating knobs, cut-outs etc. are introduced directly into the at least one first plate 8 and/or into the at least one second plate pointing inward in the direction of the at least one flow duct 21, 22 and/or pointing outward.

This application claims priority from German Patent Application No. 10 2006 044 154.0, filed Sep. 15, 2006, all of which is incorporated herein by reference in its entirety.

The invention claimed is:

1. A stacked-plate heat exchanger comprising:

at least one first flow duct for at least a first medium to flow through; and at least one second flow duct for at least a second medium to flow through in order to cool the first medium, wherein the at least one first flow duct and the at least one second flow duct are formed between adjacent plates, wherein at least one of the adjacent plates comprises a first opening for the first medium to flow through and at least two second openings for the second medium to flow through, the first opening being arranged at least in certain sections between the two second openings, wherein at least a portion of the first opening is at a smaller distance from a central section of the stacked-plate heat exchanger than at least one of the second openings, and wherein at least a portion of an edge of the first opening is substantially in a shape of a normal distribution function wherein at least one section of an edge of the first opening is in a shape of a polynomial $y_n=a_nx^4+b_nx^3-c_nx^2+d_nx+e_n$ with n corresponding to a number of sections that form the shape of the polynomial.

2. The stacked-plate heat exchanger of claim 1, wherein:

the at least one of the adjacent plates comprises a plate end ring section, and the plate end ring section comprises at least one knob.

3. The stacked-plate heat exchanger as claimed in claim 1, wherein the at least one of the adjacent plates comprises a bead configured to separate the second medium from the first medium and to direct the flow of the second medium out of the at least one of the adjacent plates.

4. The stacked-plate heat exchanger as claimed in claim 3, wherein at least one bead end section of the bead is formed in a substantially delta shape in a region of one of the second openings, and wherein the at least one bead end section surrounds the one of the second openings, at least in certain areas.

5. The stacked-plate heat exchanger as claimed in claim 3, wherein the bead extends from one of the second openings to another of the second openings.

6. The stacked-plate heat exchanger as claimed in claim 1, wherein the first opening is of symmetrical design.

7. A stacked-plate heat exchanger comprising:

at least one first flow duct for at least a first medium to flow through; and at least one second flow duct for at least a second medium to flow through in order to cool the first medium, wherein the at least one first flow duct and the at least one second flow duct are formed between adjacent plates, wherein at least one plate comprises a first opening for the first medium to flow through and at least two second openings for the second medium to flow through, the first opening being arranged at least in certain sections between the two second openings, wherein at least a portion of the first opening is at a smaller distance from a central section of the stacked-plate heat exchanger than at least one of the second openings, and wherein at least a section of an edge of the first opening is in a shape of a polynomial $y_n=a_nx^4+b_nx^3-c_nx^2+d_nx+e_n$ with n corresponding to a number of sections that form the shape of the polynomial.

8. The stacked-plate heat exchanger as claimed in claim 2, wherein in a region of the plate end ring section, the edge of the first opening is spaced apart from a plate edge of the at least one of the adjacent plates by 2 mm to 30 mm.

9. The stacked-plate heat exchanger as claimed in claim 8, wherein the plate edge has an edge section, wherein an angle between the at least one edge at the edge section and a flow direction of the first medium is between 40° and 70°.

* * * * *